US005253301A

United States Patent [19]

Sakamoto et al.

[11] Patent Number: 5,253,301

[45] Date of Patent: Oct. 12, 1993

[54] NONDIRECTIONAL ACOUSTIC GENERATOR AND SPEAKER SYSTEM

[75] Inventors: Masakatsu Sakamoto; Shiro Iwakura; Kaoru Yamazaki, all of Tokyo, Japan

[73] Assignee: Kabushiki Kaisha Kenwood, Tokyo, Japan

[21] Appl. No.: 499,705

[22] Filed: Mar. 27, 1990

[30] Foreign Application Priority Data

Mar. 31, 1989 [JP] Japan ..... 1-78373

[51] Int. Cl.[5] ..... H04R 1/02

[52] U.S. Cl. ..... 381/89; 381/188; 381/205; 381/159; 181/145

[58] Field of Search ..... 381/89, 90, 205, 188, 381/154, 159; 181/145

[56] References Cited

U.S. PATENT DOCUMENTS 3,076,520 2/1963 Farwell ..... 181/145
3,477,540 11/1969 Rizo-Patron ..... 381/182
4,326,099 4/1982 Maille ..... 381/182

FOREIGN PATENT DOCUMENTS 558119 1/1975 Switzerland ..... 181/145

*Primary Examiner*—Forester W. Isen
*Attorney, Agent, or Firm*—Sixbey, Friedman, Leedom & Ferguson

[57] ABSTRACT

A nondirectional acoustic generator includes two acoustic generator units which are disposed facing each other as near as possible to the extent that diaphragms thereof do not become in contact with each other, drive units of the acoustic generator units being connected in series or in parallel to drive the acoustic generator units in phase and generate air compression sound waves which are radiated in the circumferential direction of the diaphragms.

A speaker system includes a plurality of nondirectional acoustic generators coaxially disposed so as to align the centers of respective diaphragms and make the phases at sound generating areas coincident with each other.

9 Claims, 16 Drawing Sheets

NONDIRECTIONAL ACOUSTIC GENERATOR AND SPEAKER SYSTEM

BACKGROUND OF THE INVENTION

1. Field of the Invention

The present invention relates to a nondirectional acoustic generator and speaker system wherein two acoustic generator units or speaker units are disposed such that diaphragms thereof become as near as possible and driven in phase to thereby radiate sound waves suitable for obtaining a particular directivity or nondirectivity.

2. Related Background Art

There are known various types of conventional nondirectional speakers. For example, a speaker shown in FIG. 23 has a plurality of speaker units 22 mounted nondirectionally on a cabinet 21 to perform a respiratory operation, a speaker shown in FIG. 24 uses a piezoelectric film 23 formed in a conical or truncated conical shape to make the diaphragm itself nondirectional, and a speaker shown in FIG. 25 uses reflectors 24.

There has been proposed also a speaker shown in FIG. 26 wherein drivers (speaker units 22) for reproducing low frequency components are slanted upward, and high frequency components are adapted to be reflected by a spherical body 25 (e.g., Japanese Patent Publication No. 62-221299).

A conventional horn type speaker 31 shown in FIG. 27 on the other hand is constructed of a driver unit 33 which is driven by energy from a magnetic circuit upon application of a signal to a voice coil mounted on a diaphragm 32 formed in a horn shape, a throat unit 34 for equalizing the phase of high frequency components by means of a phase equalizer 34*a*, and a horn section for matching acoustic impedance.

In a conventional speaker system for reproducing a low frequency sound, as shown in FIG. 28 a speaker 43 is mounted on a partition plate 42 fixed within a cabinet 41, the volume ratio of air chambers 44 and 45 partitioned with the partition plate 42 is set at 1:1.2, and an acoustic filter formed by the air chamber 44 and a port 46 attenuates high frequency components. A 3D (three-dimensional) system having an improved version of the above-described driver unit is shown in FIG. 29 wherein there are provided two speakers 47 and 48, and a bathlet type acoustic filter which is formed by providing another port 49 in an air chamber 49 in addition to a port 46 in an air chamber 46. The speakers 47 and 48 are inputted with right and left stereo signals to realize a 3D speaker.

The nondirectional speaker shown in FIG. 23 is associated with some disadvantage that the baffle mounted with a plurality of speaker units 22 is difficult to be worked, resulting in high cost and a limited shape of speaker mounting frame.

The speaker made of a piezoelectric film shown in FIG. 24 has disadvantages of a necessity of impedance matching, low efficiency, and insufficient amplitude.

In the case of the speaker shown in FIG. 25 which is made nondirectional in the horizontal or vertical direction by the provision of the reflectors 24, there also arises a problem that the directivity and frequency characteristics depend on the shape of the reflector.

The speaker shown in FIG. 26 has an uneven frequency characteristic of reflected sounds by the spherical body 24 so that the directivity shows a beam shape which cannot be eliminated. In addition, there is a problem that the low frequency sound regenerating portion is theoretically far from a simple sound source. Further, in mounting the driver and the spherical or semi-spherical body for reflecting high frequency sounds, there is some mismatching between the size of the magnetic circuit and the input terminals of the drivers, resulting in a large size of the actual spherical body.

The directivity characteristic of sound waves for the conventional horn type speaker shown in FIG. 27 depends on the shape of the horn, covering only 90 to 140 degrees at most.

The speaker shown in FIG. 26 can be considered to have a partial space operating as a horn. The reason for this is that dome type speakers are driven in phase to radiate and diffuse sound waves in the direction toward a space defined by a spherical or partially spherical body so that the space defined by the wall surface of the spherical body operates mainly to reflect and diffuse sound waves. However, the speaker shown in FIG. 26 has a disadvantage that the efficiency of acoustic load and the frequency response characteristic to be obtained by such a horn is not so good.

Next, the speaker system shown in FIG. 28 requires a large air chamber. The 3D system shown in FIG. 29, although it is dedicated to low frequency reproduction only, radiates high frequency components from the port so that it has a particular directivity. Further, the conditions of the air chambers are not uniform near the diaphragms thereby increasing vibrations of the cabinet. Furthermore, the acoustic filter is defined only by the air chamber 45 and port 49 so that attenuation is small at lower frequency.

SUMMARY OF THE INVENTION

It is an object of the present invention to solve the above problems of conventional speakers and speaker system and provide a nondirectional acoustic generator and speaker system capable of presenting excellent characteristics by using a sound wave radiation method whereby the diaphragms of two acoustic generator units are disposed as near as possible and driven in phase.

A nondirectional acoustic generator of this invention comprises two acoustic generator units which are disposed facing each other as near as possible to the extent that diaphragms thereof do not become in contact with each other, drive units of the acoustic generator units being connected in series or in parallel to drive the acoustic generator units in phase and generate air compression sound waves which are radiated in the circumferential direction of the diaphragms.

In this case, the two acoustic generator units to be driven in phase are fixedly connected near at the diaphragms to cancel interaction and abnormal resonance generated by the two acoustic generator units.

The confronting acoustic generator units may be housed within speaker cabinets disposed one upon the other. The diaphragms of the acoustic generator units facing each other may be cone or dome type diaphragms. In the case of using the dome type diaphragm, the overall shape of the acoustic generator unit is formed generally of an ellipsoid in cross section, and there is formed between the confronting acoustic generator units a sound path of a horn shape in cross section having a smooth surface in the direction of radiating sound waves.

In this case, the diameters of the diaphragms of the confronting acoustic generator units are set 1:1 to 1:2 to thereby broaden the reproduction frequency band.

The height of the sound path formed between the confronting acoustic generator units whose diaphragms are disposed adjacent to each other becomes two times the height of the diaphragm. The height of the sound path is therefore determined by the height of the diaphragm.

In order to make small the height of the sound path and have a good directivity, therefore, a spherical recess is formed at the top of one of the dome type diaphragms, and the spherical recess and the dome spherical surface of the other of the dome type diaphragms are disposed facing each other.

Also in this case, the curvature of the dome type diaphragm may be made larger than that of the other dome type diaphragm having a spherical recess so that the space of the sound path formed between the diaphragms is made broader at the outer circumferential portion.

Since an air space is formed between the dome type confronting diaphragms and the throat of the sound path, a ring member may be filled in the air space.

The shape of the sound path formed between acoustic generator units is preferably formed to have the relationship of an exponential function given by the following equation:

$$S = So\,[\cos h\, mx + T \sin h\, mx]$$

where S is a horn area, So is a horn throat area $2\pi$ Rh (R is a throat radius, and h is a throat height), m is a flare factor, x is a distance, and T is a parameter.

In making the overall shape of the acoustic generator unit generally of an ellipsoid in cross section and forming a sound path of a horn shape between the acoustic generator units, the wall surface of the sound path can be formed obviously with the frame portion of the acoustic generator units. The wall surface of the sound path may be directly formed by using a top plate of the magnetic circuit component. In this case, the diameter of the top plate may be larger than that of the magnet.

A speaker system of this invention comprises a plurality of nondirectional acoustic generators coaxially disposed so as to align the centers of respective diaphragms and make the phases at sound generating areas coincident with each other, each of the nondirectional acoustic generators comprising two acoustic generator units which are disposed facing each other as near as possible to the extent that diaphragms thereof do not become in contact with each other, drive units of the acoustic generator units being connected in series or in parallel to drive the acoustic generator units in phase and generate air compression sound waves which are radiated in the circumferential direction of the diaphragms.

In this case, a cabinet confronting type nondirectional acoustic generator may be used for lower frequency sounds, and a dome type diaphragm confronting type of an ellipsoid shape in cross section may be used as middle and higher frequency sound.

In the cabinet confronting type nondirectional acoustic generator, high frequency components are attenuated by an acoustic filter defined by the stiffness of an air chamber between the diaphragms and the resistance and mass of the sound path between the cabinets. In this case, acoustic filters may be provided at a plurality of stages of the sound path.

As a low frequency speaker system, there are provided two speaker units housed within respective two cabinets which are disposed such that diaphragms of the two speaker units become as near as possible, drive units of the speaker units being connected in series or in parallel to drive the speaker units in phase, wherein there is formed in the cabinets a port or duck at the output portion of an acoustic filter defined by a stiffness of an air chamber between the diaphragms and the mass of the sound path.

In this case, acoustic filters may be formed at a plurality of stages of the sound path, or a phase inverting duct or port may be provided at the acoustic filter. This phase inverting duct or port may be provided at the area other than the acoustic filter.

In the cabinet confronting type or intra-cabinet type speaker system, right and left stereo signals are inputted to the drive units of the speaker units to reproduce the lower frequency components of the stereo signal and realize a 3D lower frequency speaker system.

Upon in-phase driving the confronting two acoustic generator units via the drive units, air in front of the diaphragms is compressed (dense) or attracted (coarse) to forcibly eject out the air to the low pressure outside (in the circumferential direction of the diaphragms). Sound waves can therefore be radiated efficiently and nondirectionally in the horizontal or vertical direction. Accordingly, acceleration speed of an air is two times as fast as a conventional speaker, to thereby improve the speaker efficiency by two-fold. The vibration systems of the confronting speaker units each interact as the acoustic load of the other vibration system.

In this case, the two acoustic generator units to be driven in phase are fixedly connected near at the diaphragms to cancel interaction and abnormal resonance generated by the two acoustic generator units.

If the speaker units are housed within the cabinets which are disposed facing each other, a sound path is formed between the cabinets. If the dome type diaphragms are used as the diaphragms to be disposed facing each other and the overall shape of the acoustic generator unit is formed generally of an ellipsoid in cross section, there is formed between the confronting acoustic generator units a sound path of a horn shape in cross section having a smooth surface in the direction of radiating sound waves. In this case, the diameters of the diaphragms of the confronting acoustic generator units are set 1:1 to 1:2 to thereby broaden the reproduction frequency band.

In disposing two confronting dome type diaphragms adjacent each other, a spherical recess is formed at the top of one of the dome type diaphragms, and the spherical recess and the dome spherical surface of the other of the dome type diaphragms are disposed facing each other, to thereby making small the height of the sound path and further improving the directivity.

In disposing two dome type diaphragms facing each other, a ring member is filled in the air space formed between the diaphragms and the throat of the sound path, it becomes possible to prevent the sound pressure level from being lowered.

In forming a sound path of a horn shape between acoustic generator units by making the overall shape in cross section of the acoustic generator unit generally of an ellipsoid, a top plate of the magnetic circuit component may be used to form the wall surface of the sound path, to thereby remove the air space.

If the sound path between the acoustic generator units is formed to have a relationship of a predetermined exponential function, the acoustic load is surely imparted to another corresponding vibration system so that a good matching between the diaphragms and air can be obtained to thereby allow a high radiation efficiency.

In a speaker system wherein a plurality of nondirectional acoustic generators coaxially disposed so as to align the centers of respective diaphragms and make the phases at sound generating areas coincident with each other, each of the nondirectional acoustic generators including two acoustic generator units described above whose diaphragms are disposed facing each other as near as possible, a cabinet confronting type nondirectional acoustic generator may be used for lower frequency sounds, and a dome type diaphragm confronting type of an ellipsoid shape in cross section may be used as middle and higher frequency sounds, to thereby realize a speaker system nondirectional over lower, middle and higher frequency ranges.

In the cabinet confronting type nondirectional acoustic generator, high frequency components are attenuated by an acoustic filter defined by the stiffness of an air chamber between the diaphragms and the resistance and mass of the sound path between the cabinets. In this case, acoustic filters may be provided at a plurality of stages of the sound path, to further enhance the attenuation effect.

In a low frequency speaker system wherein there are provided two speaker units housed within respective two cabinets which are disposed such that diaphragms of the two speaker units become as near as possible, drive units of the speaker units being driven in phase, a port or duct is formed in the cabinets at the output portion of an acoustic filter defined by a stiffness of an air chamber between the diaphragms and the mass of the sound path, to thereby make the system nondirectional either in the horizontal or vertical direction. Further, by forming acoustic filters at a plurality of stages of the sound path, the filter cut-off characteristic can be improved. Furthermore, by providing a phase inverting duct or port at the acoustic filter, the low frequency characteristic can be adjusted.

In the cabinet confronting type or intra-cabinet type speaker system wherein right and left stereo signals are inputted to the drive units of the speaker units to reproduce the lower frequency components of the stereo signal and realize a 3D lower frequency speaker system, if the right and left stereo signals are opposite in phase, sound waves can not be radiated. However, ordinary signals are in phase at the lower frequency range so that the above system can reproduce lower frequency components.

Further, by forming acoustic filters at a plurality of stages of the sound path, the filter cut-off characteristic can be improved. Furthermore, by providing a phase inverting duct or port at the acoustic filter, the low frequency characteristic can be adjusted.

DETAILED DESCRIPTION OF THE PREFERRED EMBODIMENTS

Preferred embodiments of the nondirectional acoustic generator and speaker system according to this invention will be described with reference to FIGS. 1 to 22 wherein A generally represents a nondirectional acoustic generator, and B generally represents a speaker system.

Figure 1:
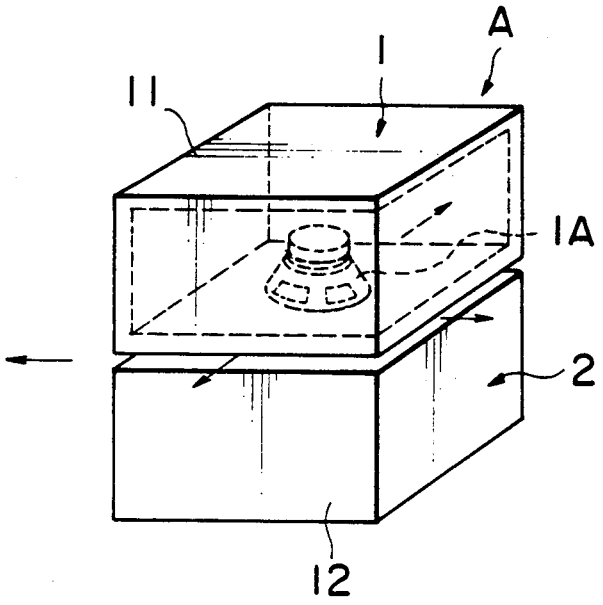
FIG. 1 is a perspective view showing a nondirectional acoustic generator using a speaker unit having a cone type diaphragm according to an embodiment of this invention.
Figure 2:
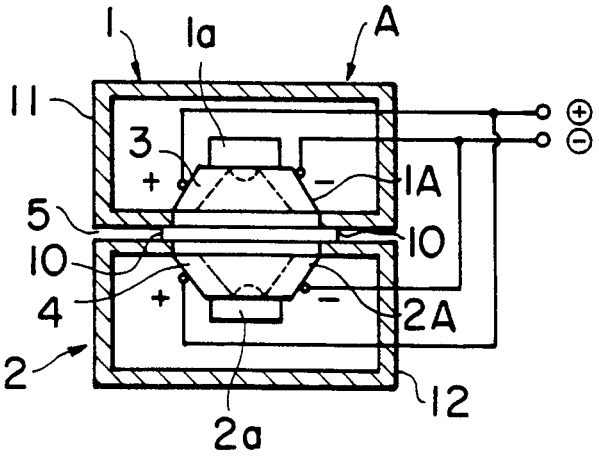
FIG. 2 is the cross sectional view of FIG. 1.

FIG. 1 is a perspective view showing a nondirectional acoustic generator using a speaker unit having a cone type diaphragm according to an embodiment of this invention; and FIG. 2 is the cross sectional view of FIG. 1.

The nondirectional acoustic generator A of this embodiment has tow acoustic generator units 1 and 2 which are disposed facing each other as near as possible to the extent that diaphragms 3 and 4 thereof do not become in contact with each other even at the amplitude when a maximum drive input is applied. Drive units 1a and 2a of the acoustic generator units 1 and 2 are connected in series or in parallel to drive the units in phase and generate air compression sound waves which are radiated in the circumferential direction of the diaphragms 3 and 4.

In the embodiment shown in FIGS. 1 and 2, each acoustic generator is constructed of a speaker unit of 18 cm diameter having an ordinary cone type diaphragm, the speaker unit being housed within a cubic (three-dimensional) cabinet. The two acoustic generator units 1 and 2 disposed face to face. Specifically, the cabinets 11 and 12 are disposed face to face such that the diaphragms 3 and 4 of the speaker units 1A and 2A of the acoustic generator units 1 and 2 are disposed as near as possible to the extent that they do not become in contact with each other even at the amplitude when a maximum drive input is supplied. The acoustic generator units 1 and 2 are coupled together near at their frames by means of a support member 10.

A drive input signal is supplied to the acoustic generator units 1 and 2 in an in-phase manner, and air in front of the diaphragms 3 and 4 is compressed (dense) or attracted (coarse) to forcibly eject out the air to the low pressure outside. Sound waves can therefore be radiated efficiently in the horizontal or vertical direction via a sound path 5 formed between the acoustic generator units 1 and 2.

Acceleration speed of an air is two times as fast as a conventional speaker, to thereby improve the speaker efficiency by two-fold. The vibration systems of the speaker units 1A and 2A each interact as the acoustic load of the other vibration system.

Figure 3:
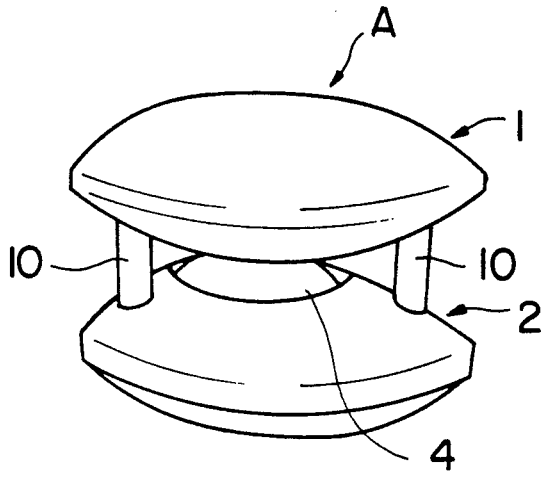
FIG. 3 is a perspective view showing a nondirectional acoustic generator wherein the overall cross section of a speaker system is formed generally of an ellipsoid shape by using dome type diaphragms.
Figure 4:
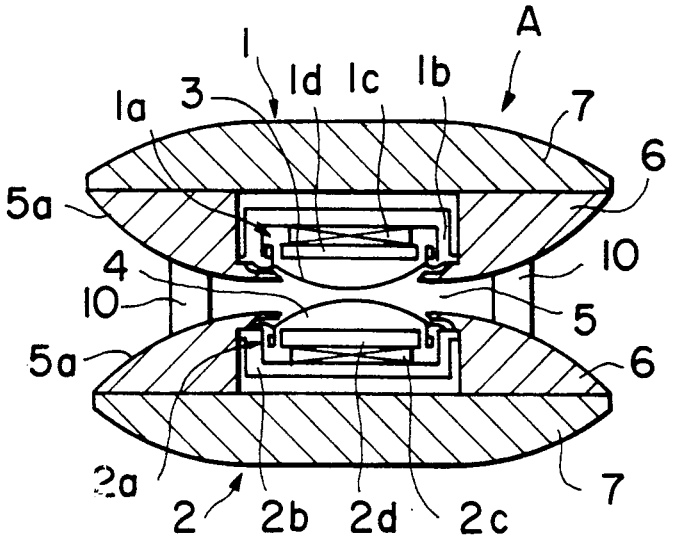
FIG. 4 is the cross sectional view of FIG. 3.

FIGS. 3 and 4 show another embodiment wherein acoustic generator units 1 and 2 using dome type diaphragms 3 and 4 are disposed face to face. In this embodiment, two types of acoustic generator units 1 and 2 were provided. One type of the acoustic generator units 1 and 2 uses dome type diaphragms of 25 mm diameter for high frequency use, and the other type uses dome type diaphragms of 60 mm diameter for middle frequency use. The shorter the distance (gap) between the diaphragms, the better the conversion efficiency and high frequency characteristic. It is preferable that the distance is 1 mm or shorter for the diaphragms of 25 mm diameter, and 2 mm or shorter for the diaphragms of 60 mm diameter.

In order to radiate sound waves efficiently in the radial direction upon in-phase drive of the acoustic generator units 1 and 2, a sound path 5 has a shape of horn in cross section, and in order to alleviate the influence of reflection and diffraction at the outlet of the horn, the horn wall surface 5a is formed symmetrical. The acoustic generator units 1 and 2 including a frame 6 and reflection preventing cover 7 disposed at the back of the frame 6, are therefore formed as a whole in a shape of an ellipsoid in cross section as shown in FIG. 4. The acoustic generator units 1 and 2 coupled together by means of support members 10. By coupling the acoustic generator units 1 and 2 near at the diaphragms 3 and 4, vibrations such as interaction and abnormal resonance generated by the acoustic generator units 1 and 2 can be cancelled out. In FIG. 4, 1b and 2b represent a yoke, 1c and 2c a magnet, and 1d and 2d a magnetic pole.

The cut-off frequency (of the horn) which determines the lower frequency limit of the acoustic generator units 1 and 2 was set at 2,000 Hz for the high frequency use of 25 mm diameter diaphragms, and at 810 Hz for the middle frequency use of 60 mm diameter diaphragms. The dome type diaphragms 3 and 4 were made of titanium foil. In order to allow an efficient mounting of the horn, the magnetic circuit was formed as an inner magnetism type of 32 mm diameter by using a rare-earth neodymium magnet having a maximum magnetic energy ten times as large as that of a barium magnet.

Figure 5:
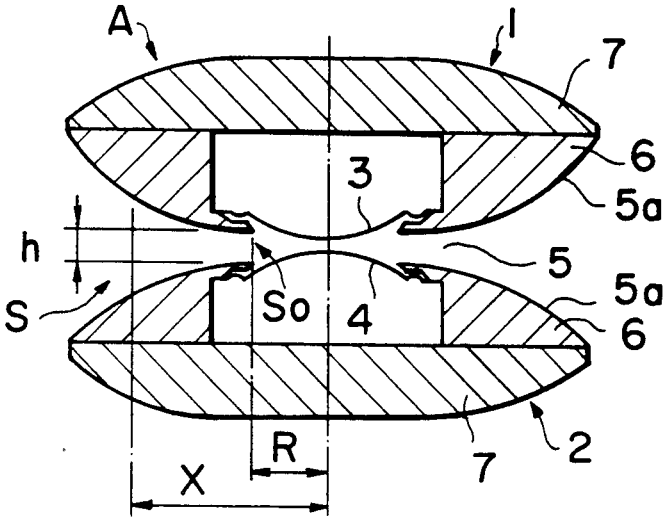
FIG. 5 is a cross sectional view used for explaining the exponential function associated with the sound path of the embodiment shown in FIG. 4.

The shape of the sound path 5 is preferably formed to have the relationship of an exponential function given by the following equation, in connection with FIG. 5.

$$S = So\,[\cos h\, mx + T \sin h\, mx]$$

where S is a horn area, So is a horn throat area $2\pi$ Rh (R is a throat radius, and h is a throat height), m is a flare factor, x is a distance, and T is a parameter.

The exponential horn used in this embodiment had the following characteristics. Namely, it had the cut-off frequency fc=2,000 Hz where the area ($2\pi$ Rh) determined by the diaphragm height h and the diaphragm radius R changes with T=1, the horn opening of 90 degrees, and a flare cut.

The above-described nondirectional acoustic generator units realized a nondirectional speaker unit covering the frequency range of 2.5 Khz to 20 Khz over the horizontal surface of 360 degrees and vertical surface of 140 degrees.

In the case of a hyperbolic horn having the horn shape parameter of T=0.5 to 0.7, the low frequency characteristic of a speaker can be improved.

Figure 6:
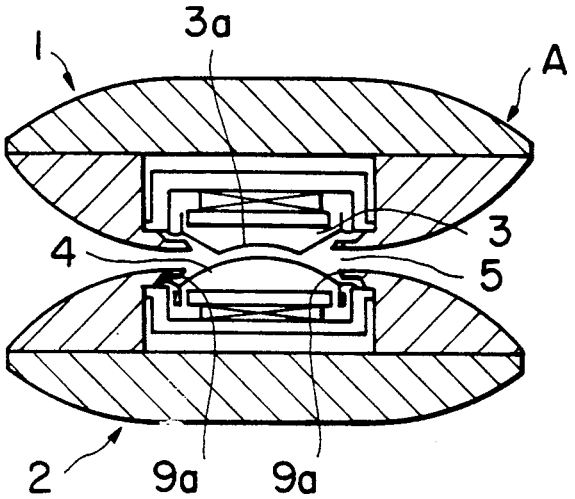
FIG. 6 is a cross sectional view showing one of the dome type diaphragms formed at its top with a spherical recess.

In an embodiment shown in FIG. 6, the lower acoustic generator unit 2 uses an ordinary dome type diaphragm 4 of 25 mm diameter, and the upper acoustic unit 1 uses a dome type diaphragm 3 having at its top a spherical recess 3a.

The sound path 5 of this embodiment becomes narrower than those shown in FIGS. 3 and 4 because the top of the diaphragm 4 extends within the spherical recess 3a of the diaphragm 3, thereby improving the directivity in the vertical direction.

Figure 7A:
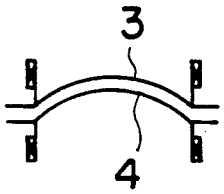
FIGS. 7A to 7C are schematic cross sections showing the modifications of the embodiment shown in FIG. 6.
Figure 7B:
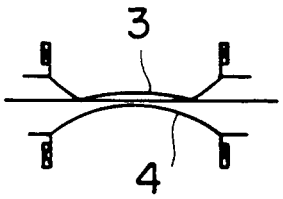
Figure 7C:
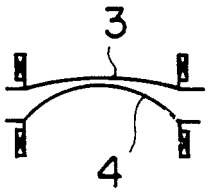

FIGS. 7A to 7C show other examples of the dome type diaphragms 3 and 4 shown in FIG. 6 having different curvatures. With these modifications, smooth sound radiation becomes possible, to thereby reduce air flow distortion without degrading the directivity in the vertical direction.

Figure 8:
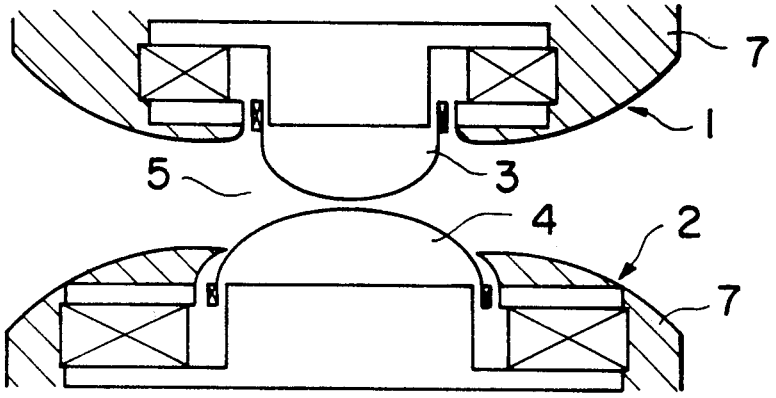
FIG. 8 is a cross sectional view showing the diaphragms having different diameters.

An embodiment shown in FIG. 8 uses dome type diaphragms 3 and 4 having different diameters whereby when they are in-phase driven, the diaphragm having a larger diameter acts as a reflector. In this embodiment, the diameter of the diaphragm 4 was set at 50 mm and that of the diaphragm 3 at 25 mm. By using the diaphragms 3 and 4 facing each other and having different diameters, the diaphragm 4 with a larger diameter operates to reproduce a lower frequency and the diaphragm 3 with a smaller diameter operates to reproduce a higher frequency, to thereby allow a broader frequency band.

It is important to set a diaphragm diameter ratio while realizing a broader frequency band without lowering the efficiency. In view of this, the maximum ratio is preferably about 1:2. With the diaphragms 4 of 50 mm diameter and the diaphragm 3 of 25 mm diameter, it is possible to obtain the reproduction frequency band of 800 to 2,000 Hz, realizing a nondirectional speaker serving as a middle frequency speaker.

Figure 9A:
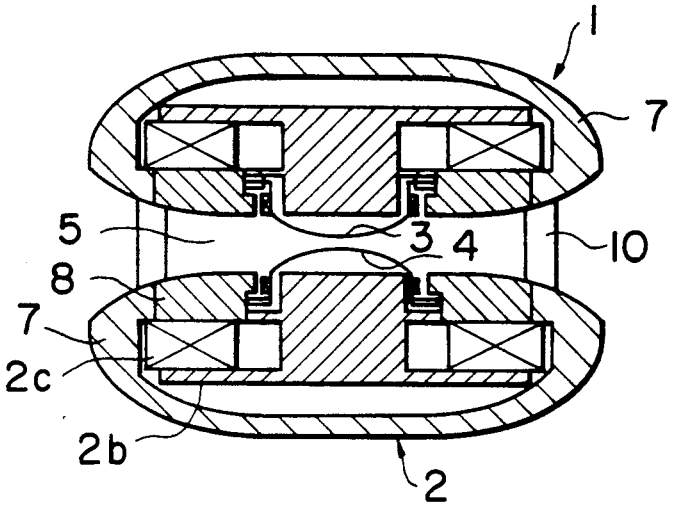
FIGS. 9A and 9B are cross sectional views wherein the wall surface of the sound path is formed by using a top plate.

FIG. 9A shows an embodiment wherein the magnetic circuit is of an external magnetism type and a part of the sound path 5 is formed by using a top plate 8 of the magnetic circuit component. The dome type diaphragms 3 and 4 were made of titanium, and the magnet 2c used a ferrite magnet of 75 mm diameter. The shape of the sound path 5 was designed to have the exponential relationship described with FIG. 5, and the top plate 8 was cut to satisfy the relationship.

In the embodiments shown in FIGS. 3 to 8, there is formed as seen from FIG. 6 an air chamber 9a between the dome type diaphragms 3 and 4 and the throat of the sound path 5. There is a possibility of lowering the high frequency sound level because of the resonance of the air chamber 9a. However, the embodiment shown in FIG. 9A does not form such air chamber 9a so that the high frequency sound level can be prevented from being lowered and the number of components can be reduced.

Figure 9B:
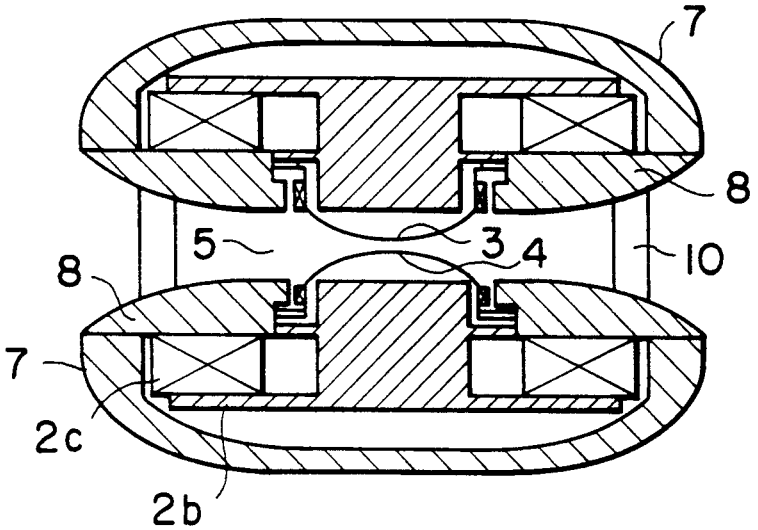

An embodiment shown in FIG. 9B uses the top plate 8 shown in FIG. 9A which has a larger diameter than that of the magnet 2c so that the reflection preventing cover 7 and speaker unit are allowed to be mounted in various ways.

Figure 10:
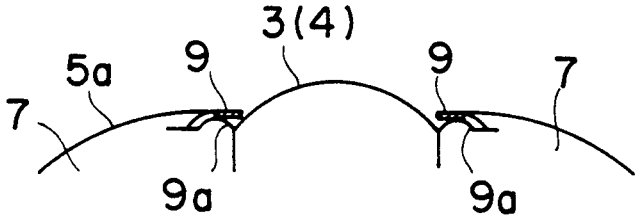
FIG. 10 is a cross sectional view showing the main part of an embodiment wherein a ring member is fitted in an air chamber formed between the dome type diaphragm and the throat of the sound path of a horn shape.

In order to prevent the high frequency sound level from being lowered because of the presence of the air chamber 9a, a ring member 9 made of a resilient material such as foam urethane or sound absorbing material such as glass wool may be filled in the air chamber 9a as shown in FIG. 10. In the embodiment shown in FIG. 9B, the dome type diaphragms 3 and 4 were made of titanium and had an ordinary 25 mm diameter, and the magnetic circuit was made compact by using a neodymium magnet and had a 32 mm diameter.

The speaker system B of this invention is constructed of a plurality of nondirectional acoustic generators A described above which are coaxially disposed with the centers of diaphragms being aligned to make coincident the phases at sound generating areas.

Figure 11:
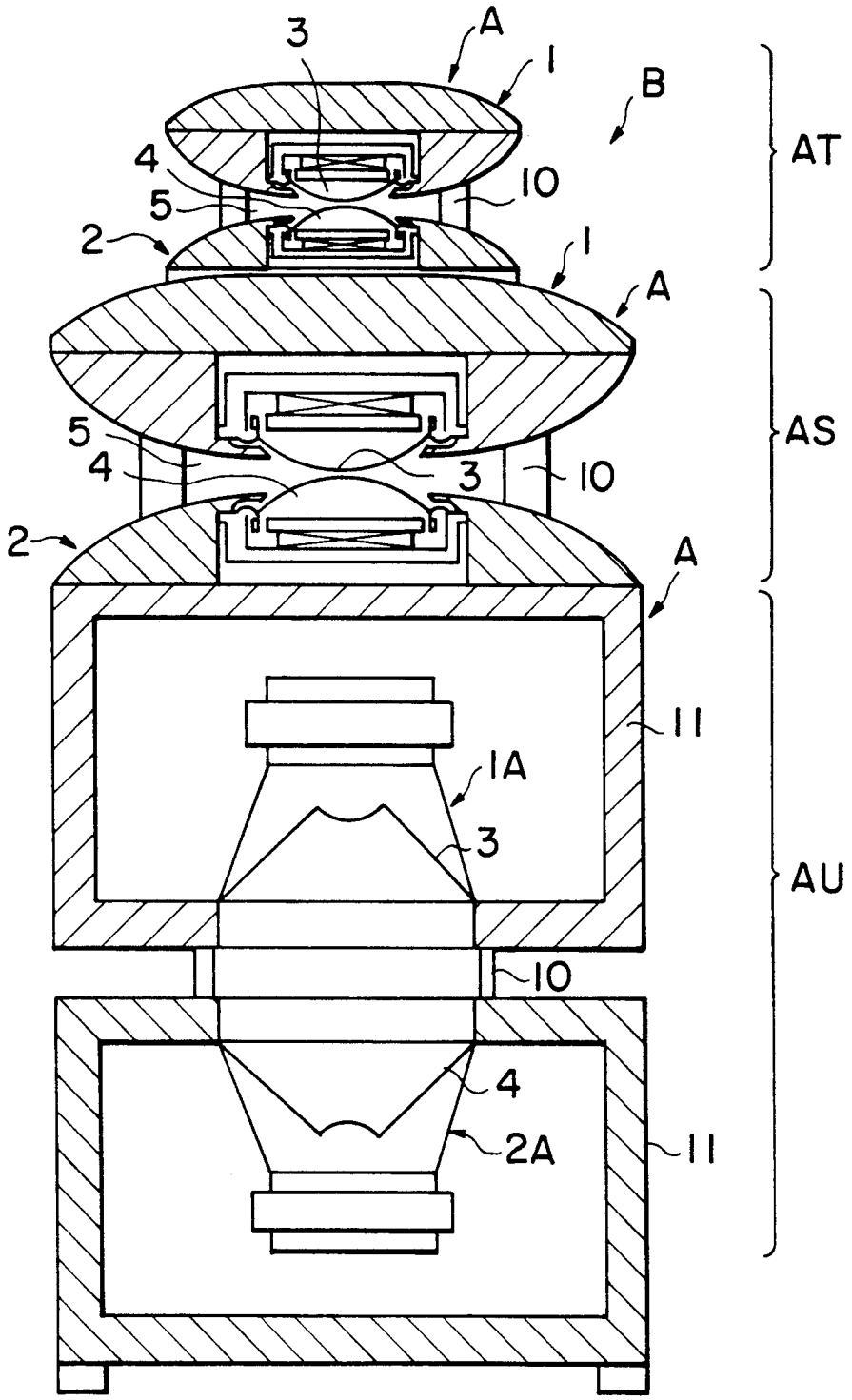
FIG. 11 is a cross sectional view showing a speaker system having a plurality of nondirectional acoustic generators superposed one upon another.

FIG. 11 shows as embodiment of a speaker system B capable of regenerating an excellent stereo sound field. This speaker system B uses as the high frequency purpose the nondirectional acoustic generator whose cabinets are disposed face to face as shown in FIGS. 1 and 2, and as the middle and low frequency purpose the nondirectional acoustic generator whose dome type diaphragms are disposed face to face as shown in FIGS. 3 and 4. The speaker system B is thereby constructed of a nondirectional woofer section AU, nondirectional scoker section AS and nondirectional tweeter section.

Figure 12:
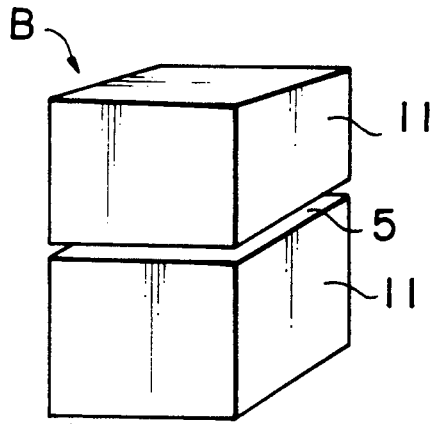
FIG. 12 is a perspective view showing a speaker system having cabinets disposed one upon another.
Figure 13A:
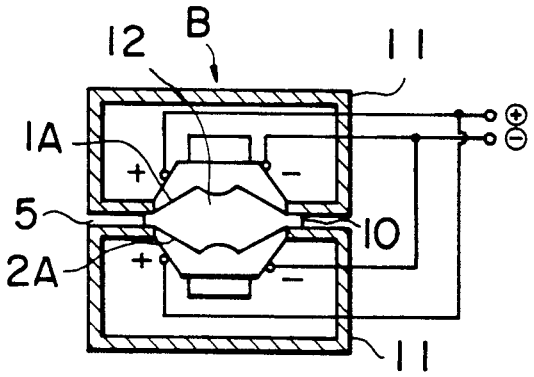
FIGS. 13A and 13B are the cross sectional views of FIG. 12.
Figure 13B:
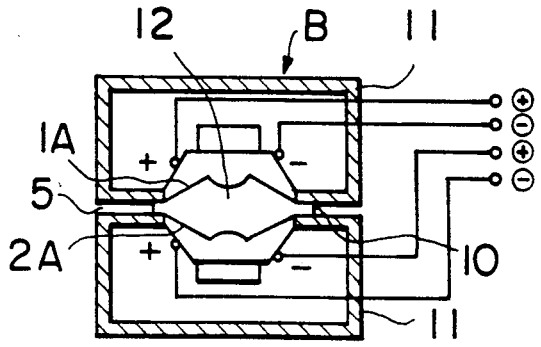

In an embodiment shown in FIGS. 12, 13A and 13B, speaker units having a cone type diaphragm are housed within cabinets with the speaker units being disposed face to face. In this embodiment, an air chamber 12 is formed between the diaphragms 3 and 4 so that there is formed an acoustic filter for attenuating high frequency components which filter is formed by the stiffness of the air chamber 12 and the mass of the sound path 5. In this embodiment, the speaker units 1A and 2A used lower frequency speaker units of 18 cm diameter, and the distance between the speaker units 1A and 1B was set about 15 mm which prevents the diaphragms (particularly their edges) from being in contact with each other even at the amplitude when a maximum drive input is applied.

Figure 14A:
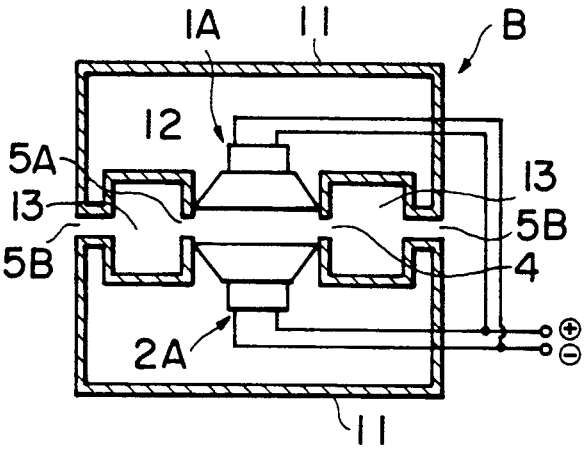
FIGS. 14A and 14B are the cross sectional views of the embodiment shown in FIG. 12 wherein acoustic filters are provided at a plurality of stages.
Figure 14B:
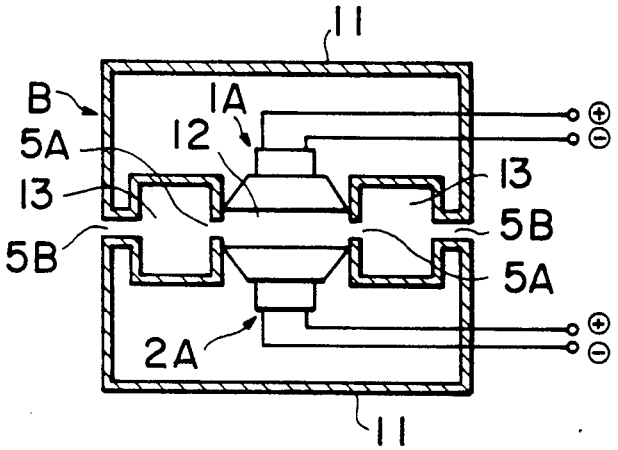

In two embodiments shown in FIGS. 14A and 14B, there are formed air chambers 13 at the sound path 5 of the speaker system shown in FIG. 13, to thereby form acoustic filters of four stages constructed of the air chamber 12, inner sound path 5A, air chamber 13 and outer sound path 5B. By changing the parameters of these acoustic filters, it is possible to provide a low frequency speaker system having a superior cut-off characteristic.

In the embodiment shown in FIG. 14A, the speaker units 1A and 2A are interconnected in an in-phase drive scheme and driven by applying right and left stereo channel signals to realize a 3D (three-dimensional) lower frequency speaker system. In the embodiment shown in FIG. 14A, the speaker units 1A and 2A are interconnected not in an in-phase drive scheme but in a 3D scheme. In an embodiment of the speaker system shown in FIG. 15, partition plates 14 and 15 facing each other are provided within a cabinet 11. Low frequency speaker units 1A and 2A of 18 cm diameter having cone type diaphragms 3 and 4 are mounted facing each other on the partition plates 14 and 15, respectively. There are formed in the cabinet 11 four ducts 17 between the partition plates 14 and 15 so that a sound path 5 is formed between the partition plates 14 and 15. An acoustic filter is formed by the stiffness of the air chamber and the mass of the sound path 5.

Figure 15:
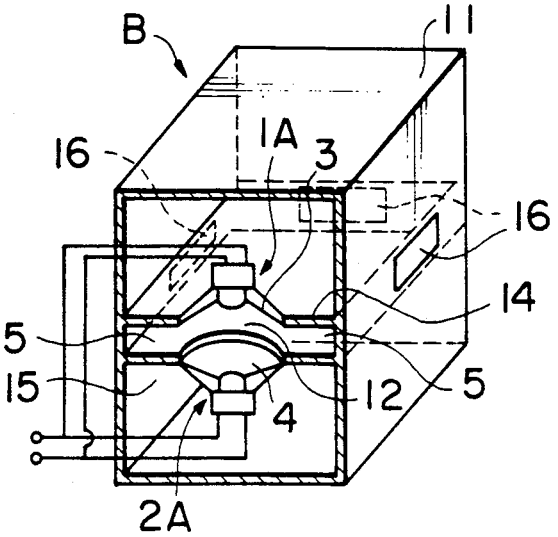
FIG. 15 is a perspective view showing a speaker system having speaker units disposed face to face within a cabinet.
Figure 16:
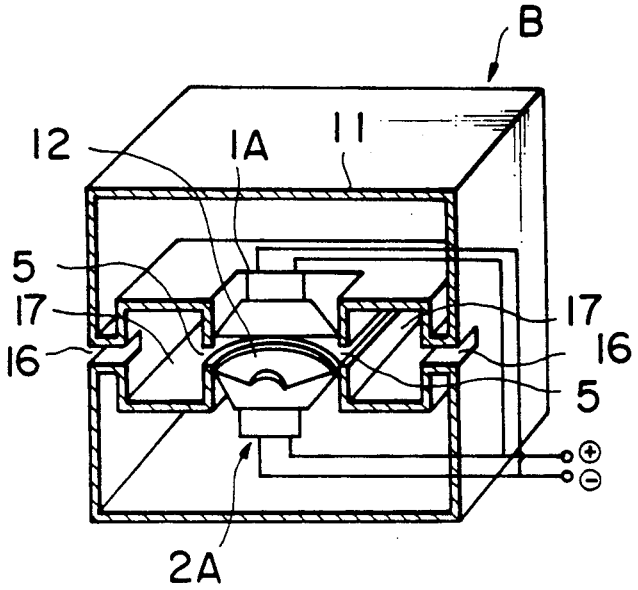
FIGS. 16, 17A and 17B are the cross sectional views of the embodiment shown in FIG. 15 wherein acoustic filters are provided at a plurality of stages.

In an embodiment shown in FIG. 16, there are further formed an air chamber 17 at the sound path 5 of the speaker system shown in FIG. 15, and ducts (or ports) 16 at the outlets of the sound path 5, to thereby provide a low frequency speaker system having an improved cut-off characteristic of the acoustic filter.

In this embodiment also, the speaker units 1A and 2A may be interconnected in an in-phase drive scheme and driven by applying right and left stereo channel signals to realize a 3D low frequency speaker system, or they may be interconnected not in an in-phase drive scheme but also in a 3D scheme for driving them.

Figure 17A:
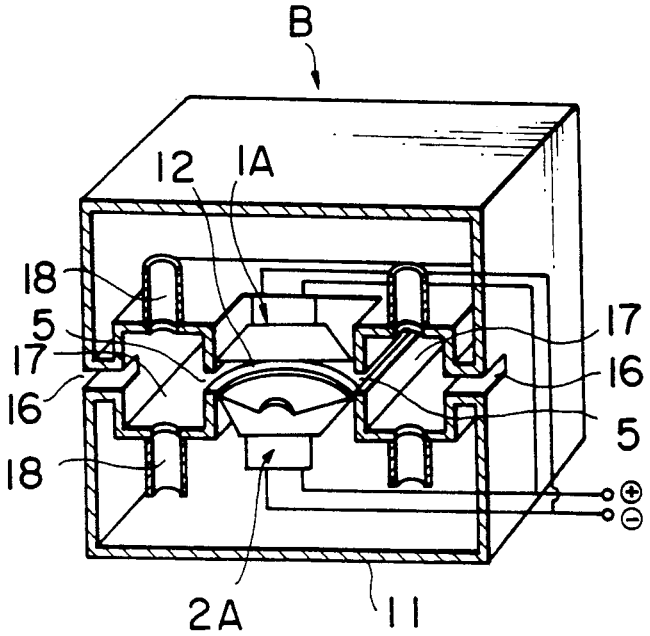

An embodiment shown in FIG. 17A is a modification of the system shown in FIG. 16, wherein at the acoustic filter formed by the stiffness of the air chamber 12 between the diaphragms 3 and 4 and the mass of the sound path 5, there are formed phase inverting ducts or ports 18. The ducts or ports 18 are formed at the upper and lower portions of one or both of the air chambers 17 to thereby allow sound waves at the ducts or ports 18 to pass through the acoustic filter.

Figure 17B:
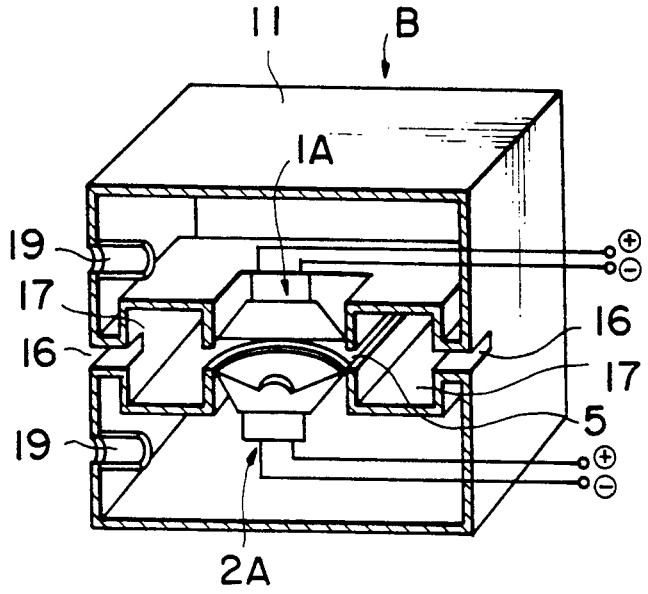

In an embodiment shown in FIG. 17B, phase inverting ducts or ports 19 are formed at the portion other than the acoustic filter, to thereby radiate sound waves directly from the cabinet 11.

Figure 18A:
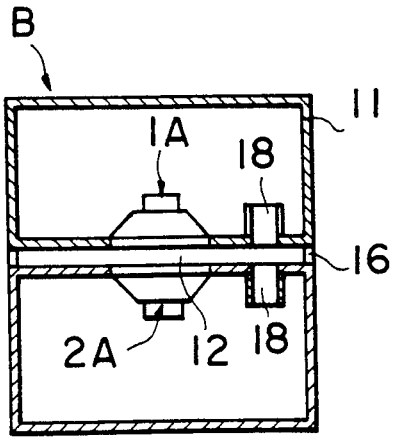
FIGS. 18A and 18B are the cross sectional views of the embodiment shown in FIG. 15 wherein a phase inverting type is incorporated.
Figure 18B:
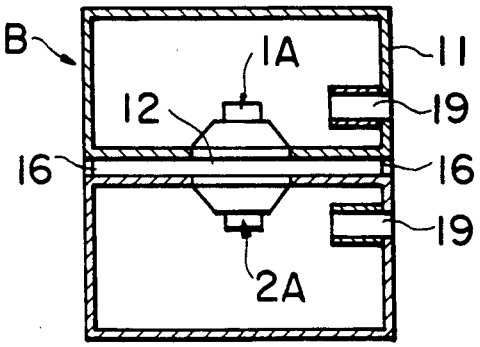

In the embodiments shown in FIGS. 16, 17A and 17B, the speaker units 1A and 2A may be interconnected in an in-phase drive scheme and driven by applying right and left stereo channel signals to realize a 3D speaker system which reproduces low frequency sound of both channels. Further, it is obvious that in the embodiments shown in FIGS. 13A and 13B, the inner ports or ducts 18 or external ports or ducts 19 as shown in FIG. 18A may be formed.

In the above embodiments, the cone type or dome type diaphragms 3 and 4 have been used. The invention is not limited thereto, and also the cabinet may be of a cylindrical, conical, semi-spherical shape or other shape. Further, the dome type diaphragms 3 and 4 disposed face to face may be formed with a spherical recess at the top of each diaphragm, and an equalizer is provided between the diaphragms.

Figure 19:
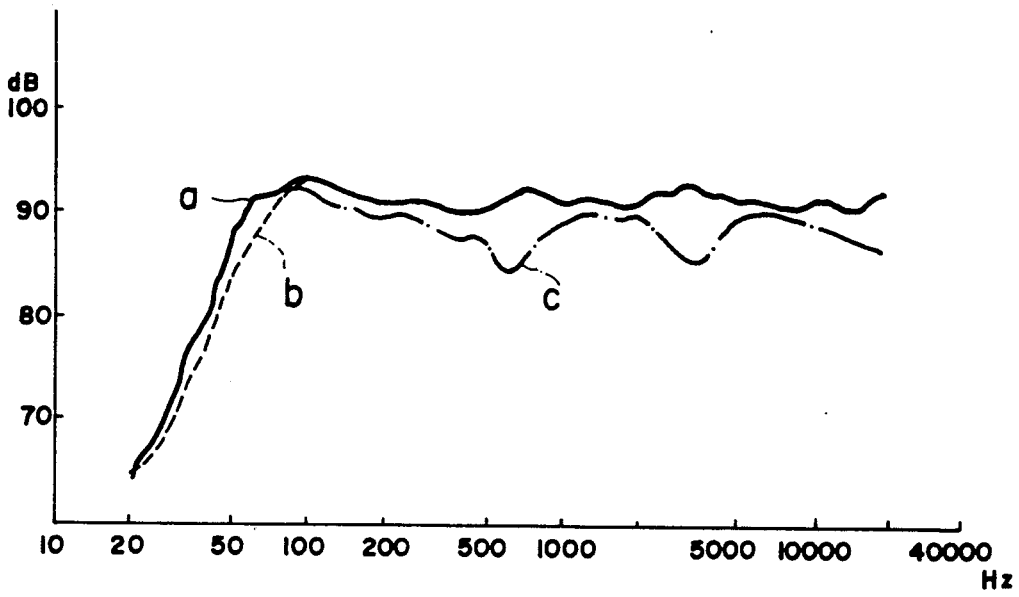
FIGS. 19 to 22 are graphs showing the frequency and directivity characteristics.

FIG. 19 is a graph showing the frequency and directivity characteristics of the nondirectional acoustic generator A of this invention, as compared with the characteristics of a conventional speaker. Curve a (solid line) indicates the frequency and directivity characteristics according to the present invention, curve b (broken line) indicates the frequency characteristic according to a conventional speaker, and curve c (one-dot chain line) indicates the directivity characteristic at the 60 degree horizontal surface according to a conventional speaker.

Figure 20:
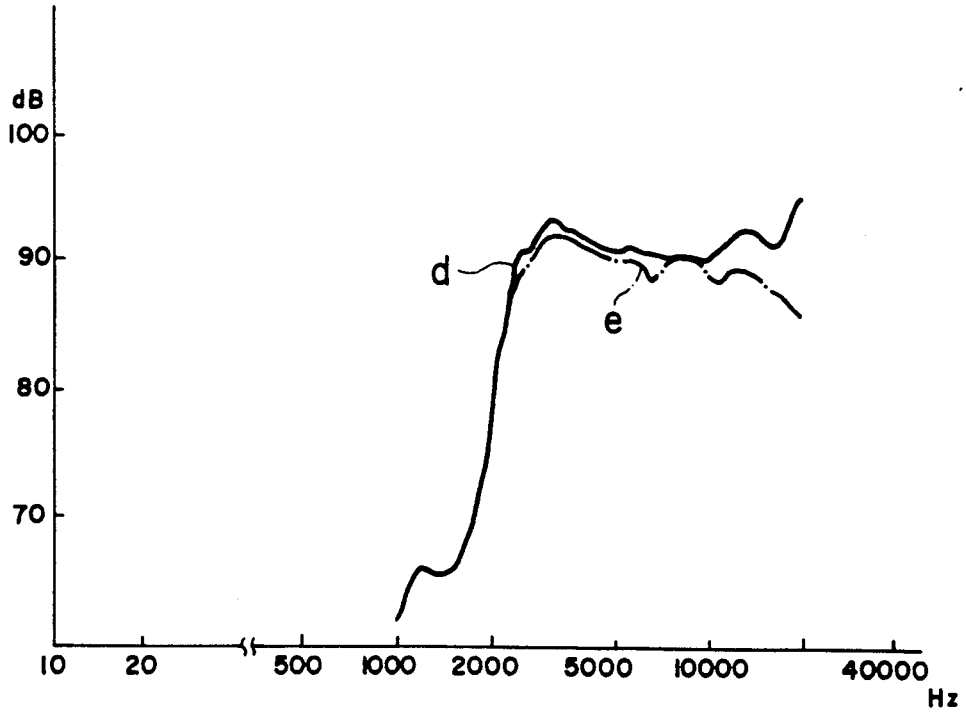

FIG. 20 is a graph showing the frequency and directivity characteristics in the horizontal surface of the nondirectional acoustic generator A with the shape of the horn at the sound path 5 having the exponential relationship described with FIG. 5, as compared with its frequency characteristic at the 70 degree vertical surface. Curve d (solid line) indicates the frequency and directivity characteristics in the horizontal surface, and curve e indicates the frequency characteristic at the 70 degree vertical surface.

Figure 21:
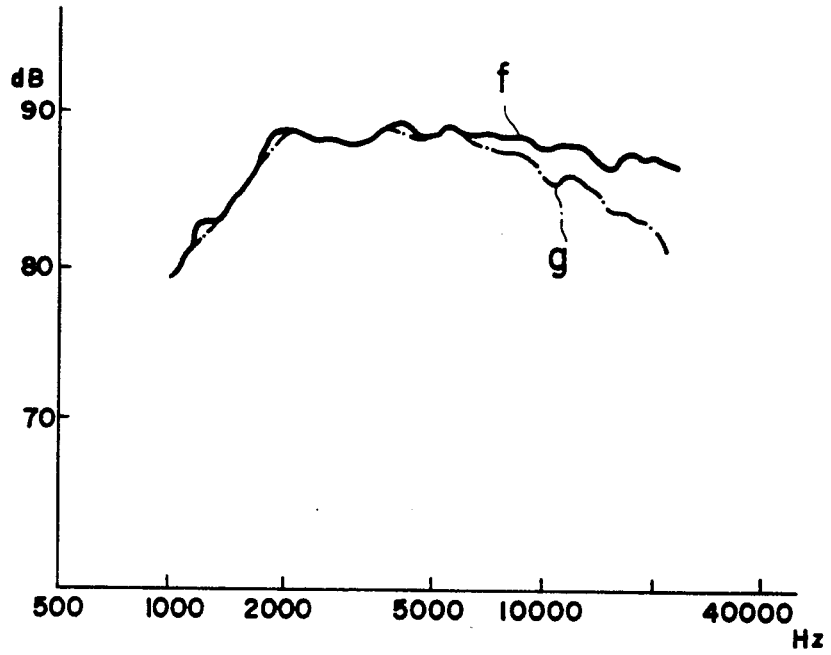

FIG. 21 is a graph showing the directivity characteristic in the vertical direction (60 degrees) of the nondirectional acoustic generator A of this invention shown in FIG. 6, as compared with the directivity characteristic in the vertical direction of a conventional speaker. Curve f indicates the directivity characteristic of this invention, and curve g (broken line) indicates the directivity characteristic according to a conventional speaker.

Figure 22:
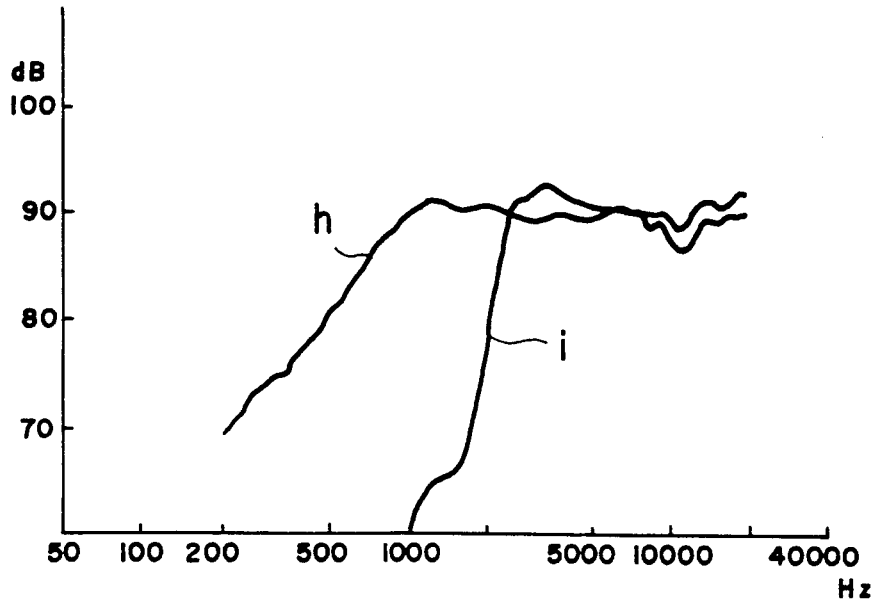
Figure 23:
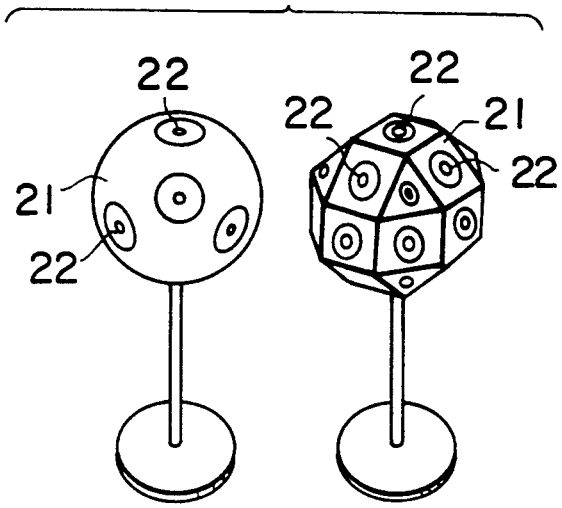
FIGS. 23 to 26 show conventional nondirectional speakers.
Figure 24:
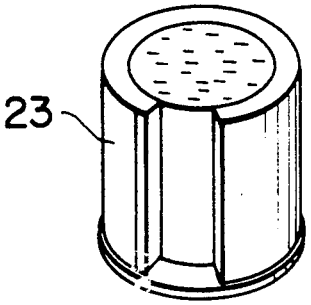
Figure 25:
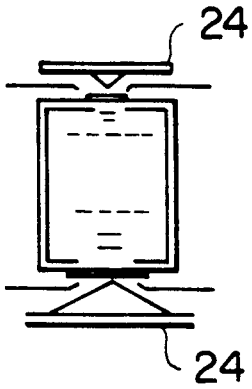
Figure 26:
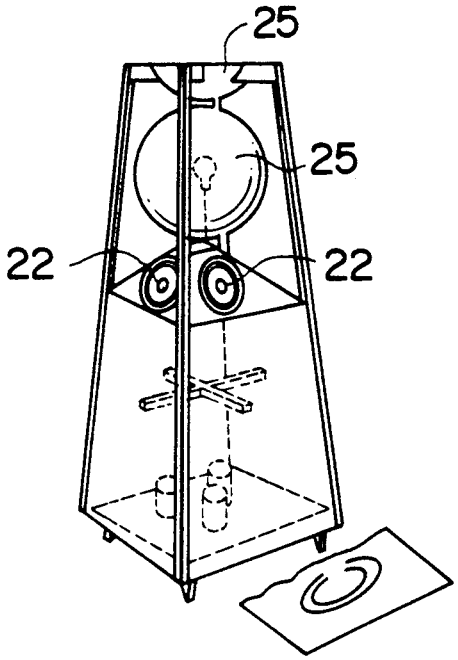
Figure 27:
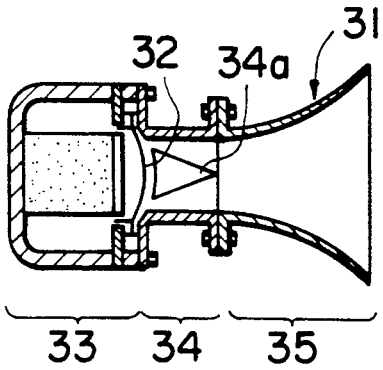
FIG. 27 shows a conventional horn type speaker.
Figure 28:
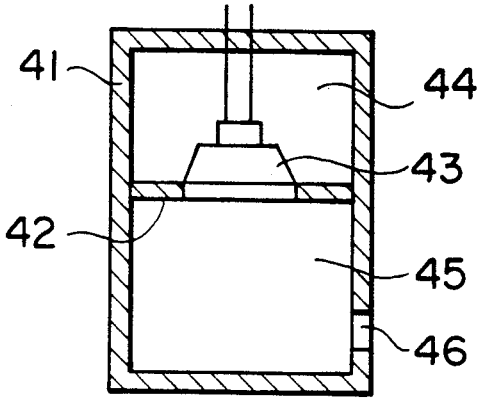
FIGS. 28 and 29 show conventional speaker systems.
Figure 29:
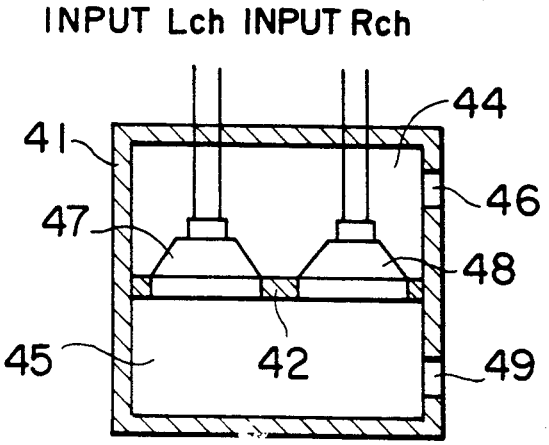

FIG. 22 is a graph showing the frequency characteristic of the nondirectional acoustic generator A of this invention shown in FIG. 8, as compared with that of a conventional speaker. Curve h indicates the characteristic according to this invention, and curve i indicates that of a conventional speaker.

As apparent from these graphs, the present invention considerably improves the frequency and directivity characteristics.

The nondirectional acoustic generator and speaker system of this invention has the following advantages.

(1) It is possible to make nondirectional an acoustic generator both in the horizontal and vertical directions.

(2) Diaphragms disposed face to face have an acoustic load with respect to each other so that the efficiency of the nondirectional acoustic generator can be improved greatly as compared with a conventional reflect type nondirectional acoustic generator.

(3) With the above advantage (2), the low frequency characteristic is improved and distortion is reduced.

(4) Matching with air becomes good so that distortion can be reduced.

(5) The low frequency characteristic can be controlled by phase inverting ducts or ports.

While the presently preferred embodiments of the present invention have been shown and described, it is to be understood that this disclosure is for the purpose of illustration and that various changes and modifications may be made without departing from the scope of the invention as set forth in the appended claims.

What is claimed is:

1. A nondirectional speaker system comprising:

a first acoustic generator unit including a first diaphragm and a first acoustic enclosure;

a second acoustic generator unit including a second diaphragm and a second acoustic enclosure;

support means for arranging said first and second acoustic generator units so that said first and second diaphragms face each other with a predetermined gap approximately equal to an allowable maximum diaphragm traveling distance and a sound path which communicates with an environmental free space to radiate sound from said gap is formed between outer surfaces of said first and second acoustic enclosures; and electric circuit means for driving said first and second diaphragms by the same acoustic electrical signal so that said first and second diaphragms are respectively driven in opposite directions to other, wherein said sound path is configured with an air chamber and a port an aperture of which is narrower than the cross sectional size of said air chamber to constitute an acoustic filter with a resonance frequency.

2. A nondirectional speaker system comprising:

a first acoustic generator unit including a first diaphragm and a first acoustic enclosure;

a second acoustic generator unit including a second diaphragm and a second acoustic enclosure;

supply means for arranging said first and second acoustic generator units so that said first and second diaphragms face each other with a predetermined gap approximately equal to an allowable maximum diaphragm traveling distance and a sound path which communicates with an environmental free space to radiate sound from said gap is formed between outer surfaces of said first and second acoustic enclosures wherein said diaphragms are a dome type and said sound path is in a horn shape which has a smooth inner surface in the direction of radiating sound wave; and electric circuit means for driving said first and second diaphragms by the same acoustic electrical signal so that said first and second diaphragms are respectively driven in opposite directions to other.

3. A nondirectional speaker system according to claim 2, wherein said outer surfaces of said first and second enclosures constitute the sound path as an exponential or hyperbolic horn in cross section.

4. A nondirectional speaker system according to claim 3, wherein a wall surface of said sound path is formed by a top plate of a magnetic circuit component.

5. A nondirectional speaker system according to claim 4, wherein the outer diameter of said top plate is larger than that of a magnet lying under said top plate.

6. A nondirectional speaker system according to claim 2, wherein the shape of said sound path is formed to have the relationship of an exponential function given by the following equation:

$$S = So\,[\cos h\, mx + T \sin h\, mx]$$

where S is a horn area, So is a horn throat area and equal to $2\pi$ Rh (R is a throat radius, and h is a throat height), m is a flare factor, x is a distance, and T is a parameter.

7. A nondirectional speaker system according to claim 2, wherein a ring member is disposed between said dome type diaphragms and a throat of said sound path.

8. A nondirectional speaker system according to claim 2, wherein there is formed a spherical recess at the top of one of said dome type diaphragms.

9. A nondirectional speaker system according to claim 8, wherein the curvature of one of said dome type diaphragms is smaller than that of the other.

* * * * *